United States Patent [19]

Crane et al.

[11] Patent Number: 4,826,450

[45] Date of Patent: May 2, 1989

[54] CENTERING SLEEVE FOR COAXIAL CONNECTORS

[75] Inventors: Terry A. Crane, Nevada City; Frank P. Way, Grass Valley, both of Calif.

[73] Assignee: The Grass Valley Group, Inc., Grass Valley, Calif.

[21] Appl. No.: 153,628

[22] Filed: Feb. 8, 1988

[51] Int. Cl.[4] ..... H01R 17/18

[52] U.S. Cl. ..... 439/578

[58] Field of Search ..... 439/578–588, 439/744–749, 871, 872

[56] References Cited

U.S. PATENT DOCUMENTS

| | | | |
|---|---|---|---|
| 3,128,138 | 4/1964 | Noschese | 439/579 |
| 3,970,355 | 7/1976 | Pitschi | 439/578 |
| 4,426,127 | 1/1984 | Kubota | 439/578 |

*Primary Examiner*—Joseph H. McGlynn
*Attorney, Agent, or Firm*—Francis I. Gray

[57] ABSTRACT

A centering sleeve for minimizing angular displacement of an electrical connector within a connector block has an internal hole adapted to fit closely onto the electrical connector and an external surface adapted to fit snugly within a hole in the connector block into which the electrical connector is to be inserted. The centering sleeve may have a longitudinal slit to allow the centering sleeve to be installed after the electrical connector is already attached to a coaxial cable, and depending upon the thickness of the wall of the centering sleeve may have an internal notch parallel with and diametrically opposed to the slit to provide an integrated hinge to facilitate installing the centering sleeve.

2 Claims, 1 Drawing Sheet

CENTERING SLEEVE FOR COAXIAL CONNECTORS

BACKGROUND OF THE INVENTION

The present invention relates to coaxial connectors, and more particularly to a centering sleeve for coaxial connectors which minimizes angular displacement of connector pins within a connector block.

Coaxial connectors, such as those supplied by AMP Inc. of Harrisburg, Pa., have a connector body with an exterior metal contact and an interior conductive pin or socket. An extension of the connector body includes a retention spring, a shoulder and a stepdown ferrule. A coaxial cable extends from the stepdown ferrule and is captured by the connector body such that the interior conductor is electrically connected to the interior conductive pin or socket and the shield is connected to the exterior metal contact. The coaxial connectors are inserted into a connector block having holes extending from one side to the other. The holes have a large diameter section and a smaller diameter section, the smaller diameter section having a recess that forms a flange between the two sections. The connector shoulder abuts against the flange to prevent the connector from going completely through the hole in one direction, while the spring expands into the recess to prevent the connector from being pulled back in the opposite direction, thus securing the coaxial connector in the connector block.

However the coaxial connectors when inserted into the connector blocks are subject to angular displacement, which is readily apparent when the coaxial cable attached to the connector is wiggled. This angular displacement results in the deformation of the plastic ends of the connector pins which provide guidance of the pin into the socket as well as damage to the springs and mating surfaces of the connector blocks when the connector blocks are mated with each other. Additionally connector pins may be pushed out of the connector blocks when the connector blocks are mated with each other.

Therefore what is desired is a means for centering the coaxial connectors within the connector block to minimize such angular displacement with the resulting damage.

SUMMARY OF THE INVENTION

Accordingly the present invention provides a centering sleeve for a coaxial connector that may be installed originally over a stepdown ferrule of the coaxial connector, or may be installed as a modification to existing coaxial connectors. The sleeve has an outer diameter which fits snugly within a larger diameter portion of a hole extending through the connector block, and an interior diameter which fits snugly over the stepdown ferrule where a coaxial cable exits the connector. For retrofit the sleeve has a slit along its length, and may be provided with an integral hinge along the length diametrically opposed to the slit where required by the thickness of the sleeve.

The objects, advantages and novel features of the present invention are apparent from the following detailed description when read in conjunction with the appended claims and attached drawing

DESCRIPTION OF THE PREFERRED EMBODIMENT

Figure 1:
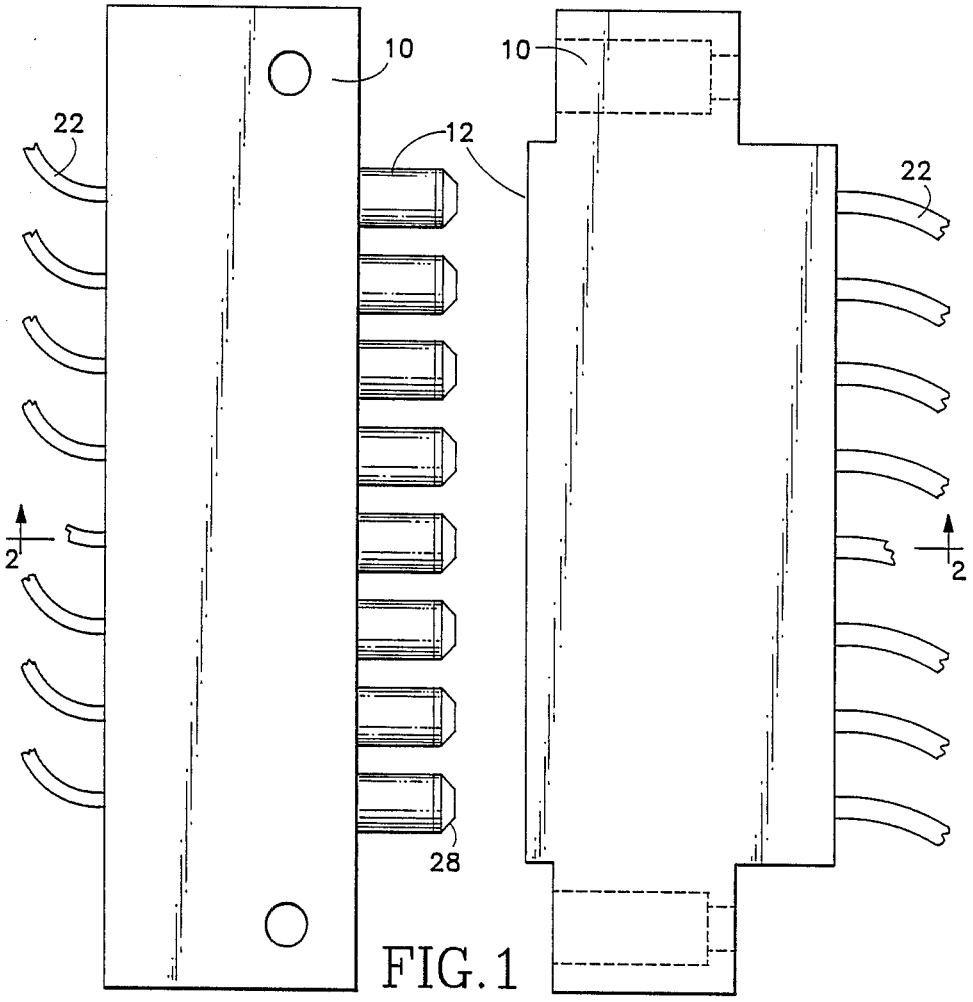
FIG. 1 is a top plan view of a connector block having a plurality of coaxial connectors extending therethrough.
Figure 2:
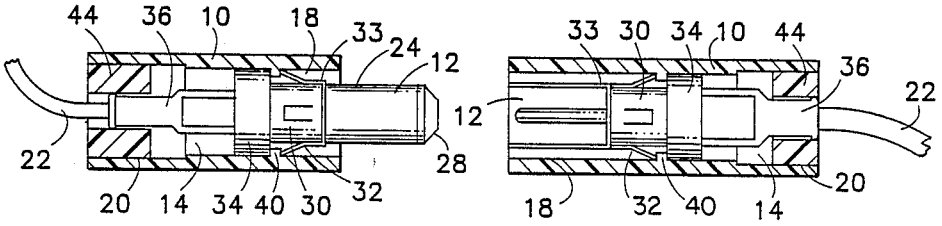
FIG. 2 is a cross-sectional view of the connector block of FIG. 1 for both a pin and a socket connector taken along the line 2—2.

Referring now to FIGS. 1 and 2 a connector block 10 is shown having a plurality of connectors 12 extending through holes 14 therethrough, the holes having a smaller diameter connector end 18 and a larger diameter cable end 20. A coaxial cable 22 to which one of the connectors 12 is connected extends from the connector block 10. Each connector 12 has an exterior contact end 24 with an interior conductive pin or socket, not shown, which are electrically connected to the cable 22. A tapered end 28 attached to the end of a male exterior contact end 24 helps to guide the contact end into a corresponding female contact end. An extension 30 of the contact end 24 has a spring 32 attached thereto, followed by two shoulders 33, 34 and a stepdown ferrule 36. The shoulders 33, 34 retain the spring 32. When the contact 12 is entered into connector block 10 via hole 20, the second shoulder 34 stops against an internal flange, or connector block shoulder, 40. The legs of the spring 32 expand and are trapped by opposite sides of the internal flange 40. As a result the connector contact 12 cannot be readily pulled from the connector block 10. Around the stepdown ferrule 36 is located a centering sleeve 44 which has an outer surface which fits snugly within the cable end 20 of the hole 14 and about the stepdown ferrule.

Figure 3:
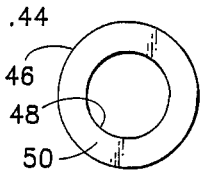
FIG. 3 is an end plan view of a centering sleeve according to the present invention.
Figure 4:
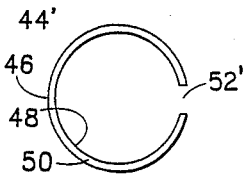
FIG. 4 is an end plan view of an alternate embodiment of the centering sleeve according to the present invention.
Figure 5:
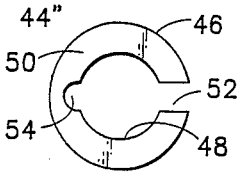
FIG. 5 is an end plan view of another alternate embodiment of the centering sleeve according to the present invention.

Various embodiments of a centering sleeve 44 are illustrated in FIGS. 3–5. Although the sleeves are shown having a cylindrical shape, the outer and inner shapes are a function of the shape of the input portion of the hole through the connector block and the stepdown ferrule of the connector itself. As shown in FIG. 3 in the simplest form the centering sleeve has a generally tubular shape having an exterior diameter 46 equal to the interior diameter of the cable end 20 of the hole 14 in the connector block 10 and an interior diameter 48 equal to the exterior diameter of the stepdown ferrule 36 of the connector 12, respectively. Although the diameter of the cable end 20 of the hole 14 may be constant for a variety of connectors 12, the diameter of the stepdown ferrule 36, and hence the inner diameter of the sleeve 44, is a function of the gauge of the coaxial cable 22 to which the connector is attached. Thus the thickness of the wall 50 of the sleeve varies from thin for thick cables to thick for thin cables. The sleeve 44 is slid over the cable and the stepdown ferrule 36 during the installation of the connector 12 on the end of the cable 22.

However to retrofit a sleeve 44 to a cable 22 already having a connector 12 would require removing the connector, sliding the sleeve onto the cable, and then reinstalling a new connector onto the cable and sliding the sleeve from the cable onto the stepdown ferrule 36 of the connector. To make such a retrofit more feasible an alternate version of the sleeve 44, as shown in FIG. 5, provides a slit 52 along the length of the sleeve parallel to the central axis. For thicker sleeves a notch 54 is provided along the length of the sleeve 44'' diametrically opposite to and parallel with the slit 52. This notch 54 provides a hinge for the sleeve 44'' so that the slit 52 may be spread wide enough to fit over the cable 22 without the need for removing the connector 12. Once installed on the cable the sleeve 44'' may be readily slid up over the stepdown ferrule 36 of the connector.

Alternatively as shown in FIG. 4 for sleeves 44' having a thin wall 50 only a slit 52' along the length of the sleeve is required because the thinness of the wall provides sufficient flexibility to allow spreading of the slit for placement on the cable 22. The result is the ability to retrofit a centering sleeve to any connector regardless of cable size without the need for removing the connector first.

Thus the present invention provides an improved coaxial connector and method for minimizing angular displacement of connector pins with resulting damage to the connector and/or connector block by having a centering sleeve either originally provided or adapted to be provided to fit around a stepdown ferrule of the connector within a hole extending through the connector block to provide a snug fit.

What is claimed is:

1. An improved electrical connector for a coaxial cable of the type having a contact end and a stepdown ferrule, the electrical connector being inserted within a hole in a connector block, wherein the improvement comprises a centering sleeve in the form of a cylindrical tube with a longitudinal slit and with an internal longitudinal notch parallel with and diametrically opposed to the slit to form an integral hinge so that the centering sleeve can be placed about the stepdown ferrule within the hole after the electrical connector has been attached to the coaxial cable, the centering sleeve closely fitting about the stepdown ferrule within the hole and having an exterior surface snugly fitting with the interior surface of the hole to minimize angular displacement of the electrical connector within the connector block.

2. A centering sleeve for a coaxial connector comprising a cylindrical tube having a slit along the length of the cylindrical tube parallel to the axis of the cylindrical tube and a notch along the internal length of the cylindrical tube parallel to and diametrically opposed to the slit to form an integral hinge.

* * * * *